US009648940B2

(12) United States Patent
Arstad

(10) Patent No.: US 9,648,940 B2
(45) Date of Patent: May 16, 2017

(54) FOLDABLE CARRYING DEVICE

(75) Inventor: Christian Arstad, Asker (NO)

(73) Assignee: SKIOX AS, Oslo (NO)

( * ) Notice: Subject to any disclaimer, the term of this patent is extended or adjusted under 35 U.S.C. 154(b) by 0 days.

(21) Appl. No.: 13/983,408

(22) PCT Filed: Feb. 7, 2012

(86) PCT No.: PCT/NO2012/000015
§ 371 (c)(1),
(2), (4) Date: Sep. 13, 2013

(87) PCT Pub. No.: WO2012/108774
PCT Pub. Date: Aug. 16, 2012

(65) Prior Publication Data

US 2014/0008403 A1 Jan. 9, 2014

(30) Foreign Application Priority Data

Feb. 7, 2011 (NO) ..... 20110293

(51) Int. Cl.
*A45F 3/14* (2006.01)
*A63C 11/02* (2006.01)

(52) U.S. Cl.
CPC ..... *A45F 3/14* (2013.01); *A63C 11/025* (2013.01)

(58) Field of Classification Search
CPC ..... A45F 3/14; A63C 11/025
USPC ..... 224/257–259, 578, 586, 609
See application file for complete search history.

(56) References Cited

U.S. PATENT DOCUMENTS

| | | | | | |
|---|---|---|---|---|---|
| 2,884,172 | A | | 4/1959 | Kubo | |
| 4,114,838 | A | * | 9/1978 | Knauf | 294/157 |
| 4,456,284 | A | * | 6/1984 | Saka | 280/812 |
| 4,518,107 | A | * | 5/1985 | Amos | 224/586 |
| 4,903,875 | A | * | 2/1990 | Smart | A63C 11/025 224/149 |
| 4,911,347 | A | * | 3/1990 | Wilhite | 224/257 |
| 4,979,659 | A | | 12/1990 | Boyd | |
| 5,335,835 | A | * | 8/1994 | Hogan | 224/257 |
| 5,383,587 | A | * | 1/1995 | Carpenter | 224/257 |
| 5,400,937 | A | * | 3/1995 | Rottenberg | 224/258 |
| 5,575,412 | A | * | 11/1996 | Arias | 224/257 |
| 5,664,721 | A | * | 9/1997 | Homeyer | 224/651 |
| 5,979,726 | A | * | 11/1999 | Chisholm et al. | 224/578 |
| 7,971,763 | B2 | * | 7/2011 | Chace | A45F 3/02 224/153 |

FOREIGN PATENT DOCUMENTS

| | | |
|---|---|---|
| CH | 265068 | 6/1947 |
| CH | 405132 | 12/1965 |
| EP | 0300971 A | 1/1989 |
| FR | 2628648 A | 9/1989 |

(Continued)

OTHER PUBLICATIONS

Supplementary European Search Report issued by European Patent Office for corresponding European patent application EP 12 74 5148 dated Jun. 25, 2014.

*Primary Examiner* — Corey Skurdal
(74) *Attorney, Agent, or Firm* — Haug Partners LLP

(57) ABSTRACT

A foldable carrying device comprising an adjustable upper and lower grip loop, where the grip loops are linked together with an adjustable shoulder strap. The carrying device may be folded into a compact device.

12 Claims, 3 Drawing Sheets

(56) References Cited

FOREIGN PATENT DOCUMENTS

| | | | |
|---|---|---|---|
| FR | 2941776 | A | 8/2010 |
| WO | WO 87/07170 | | 12/1987 |
| WO | WO 99/55434 | | 11/1999 |

* cited by examiner

FOLDABLE CARRYING DEVICE

This application is a 371 of PCT/NO2012/000015 filed on Feb. 7, 2012, published on Aug. 16, 2012 under publication number WO 2012/108774, which claims priority benefits from Norwegian Patent Application Number 2011 0293 filed Feb. 7, 2011, the disclosure of which is incorporated herein by reference.

FIELD OF THE INVENTION

The present invention concerns a carrying device to carry an elongated object and a method for using the carrying device.

BACKGROUND OF THE INVENTION

Several carrying devices for equipment carried on the back, and attached by a shoulder strap are known. U.S. Pat. No. 2,884,172 A discloses a carrying device for carrying guns, where the carrying device comprises an adjustable holder.

A ski carrying device is known from patent publication U.S. Pat. No. 5,400,937 A. The carrying device comprises an adjustable carrying strap, a pocket for the skis and a loop for fixing the skis.

These carrying devices are relatively difficult to handle and are relatively large when they are not in use. The fastening mechanisms and design make them relatively difficult to use, to take on and off, and unsuitable for carrying some kinds of equipment.

The purpose of the present invention is to provide a device and a method that addresses at least one of these problems while retaining the benefits of prior art.

SUMMARY OF THE INVENTION

This is achieved according to the invention by providing a carrying device for an elongated object characterized in that the carrying devices is foldable and comprises an adjustable upper and lower grip loop, where the grip loops are connected with an adjustable shoulder strap. In another aspect the present invention relates to a method for using the carrying device, comprising the steps of; disposing the upper grip loop around the upper section of the object, disposing the lower grip loop around the lower section of the object, and adjusting the grip loop and/or shoulder strap.

Further preferred embodiments of the invention are disclosed in the dependent claims.

BRIEF DESCRIPTION OF THE DRAWINGS

The present invention will be described in greater detail in the following with reference to the exemplary embodiments shown in the drawings, in which.

DETAILED DESCRIPTION OF A PREFERRED EMBODIMENT

Figure 2:
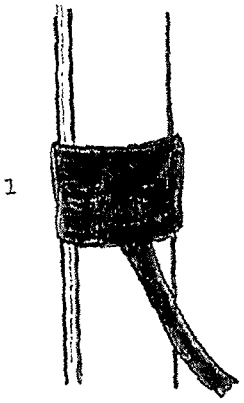
FIG. 2 shows the upper grip loop disposed around an elongated object.
Figure 3:
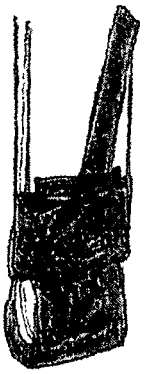
FIG. 3 shows the lower grip loop disposed around an elongated object.
Figure 1:
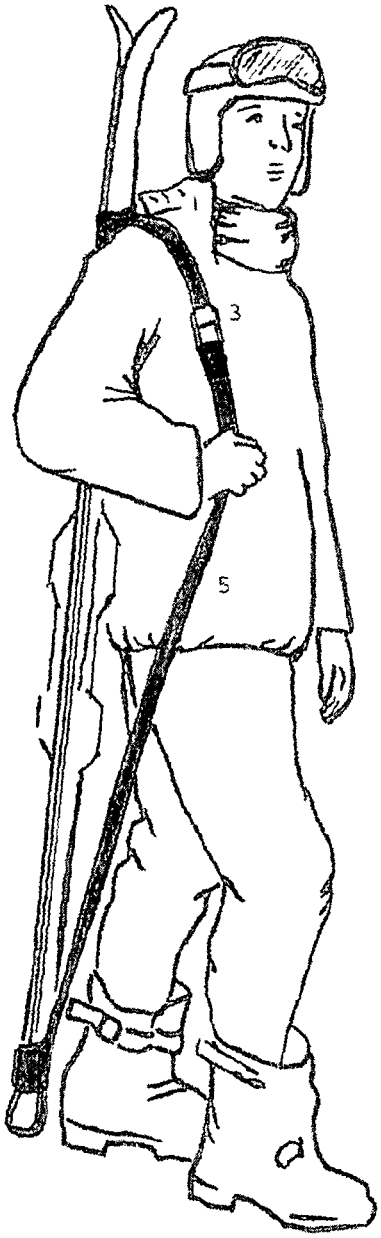
FIG. 1 shows the carrying device during use.
Figure 4:
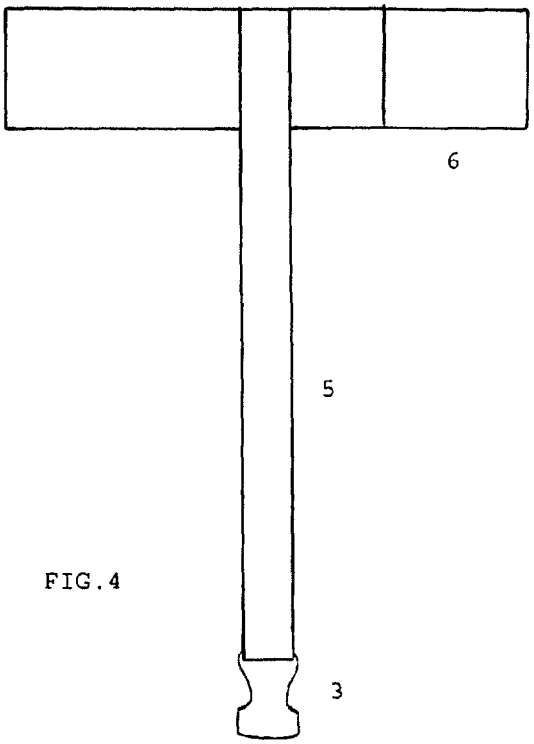
FIG. 4 displays a detailed sketch of the upper grip loop.
Figure 4A:
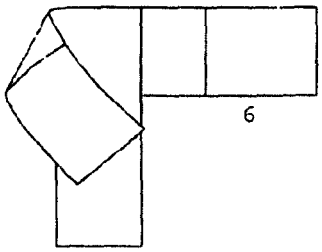
FIG. 4*a* shows details of the fastening mechanism of the grip loop.
Figure 5:
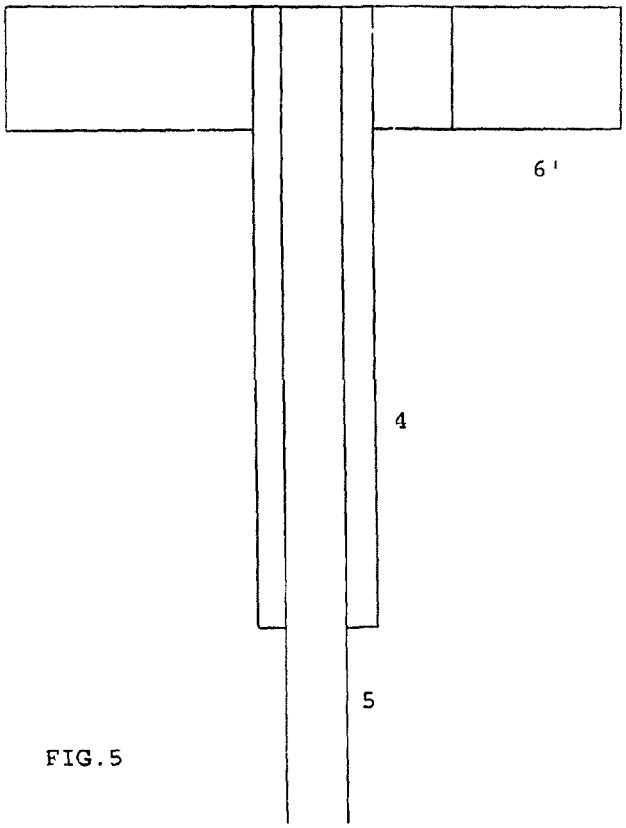
FIG. 5 shows a detailed sketch of the lower grip loop.
Figure 6:
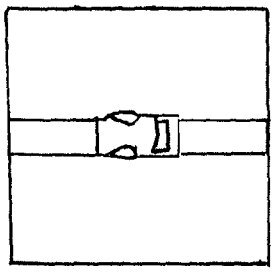
FIG. 6 shows a folded carrying device.

FIG. 1 shows a carrying device for an elongated object according to the invention. The carrying device is preferably made of straps and/or textile that can be folded, and has dimensions and other characteristics making it convenient to use, and to fold and stow away when not in use. This is described in greater detail below.

The carrying device comprises an upper adjustable grip loop 1 and a lower adjustable grip loop 2 where the grip loops 1, 2 are linked together through an adjustable shoulder strap 5 which constitutes the carrying section.

The grip loops 1, 2, have at least one cross-piece extending laterally from the shoulder strap. The cross-piece(s) of the upper grip loop 1 can be wrapped around the upper section of the elongated object and attached to each other and/or to the shoulder strap 5, by the first fastening means 6. The cross-piece(s) of the lower grip loop 2 may be wrapped around the lower part of the elongated object and attached to each other and/or to the shoulder strap 5 by means of the second fastening means 6'. The first 6 and the second 6' fastening means can be of different types, such as a buckle or a velcro. In a preferred embodiment they are of the same type, i.e. both are adjustable buckles or both are velcros. A fewer number of different component types can be expected to reduce production costs.

The lower grip loop 2 also comprises a longitudinal piece 4 in the extension of the shoulder strap 5 at its lower end, where the longitudinal piece 4 is disposed around the elongated object lower end. The cross-pieces of the grip loops 1,2 are fastened with e.g. velcro, a buckle or in any other suitable manner around the elongated object.

The adjustable shoulder strap 5 comprises a third fastening means 3, which can be of the same type as the first and second fastening means mentioned above. Alternatively, the third fastening means can be of a different type. In a preferred embodiment the shoulder strap comprises a fastening buckle, e.g. made of plastic, because such a fastening buckle will permit higher loads than a velcro. The length of the shoulder strap 5 can be adjusted by the fastening buckle 3 to fit the length of the shoulder strap to the carrying height of the user and the length of the elongated object.

The carrying device may be folded into a compact device by folding both the grip loops 1, 2, and the shoulder strap 5, and fastening it in folded state by one of the fastening means 3, 6, 6'.

A method for use of the carrying device comprises the steps of wrapping the upper grip loop 1 around an upper section of an elongated object; wrapping the lower grip loop 2 around the lower section of the elongated object and adjusting the grip loops and/or the shoulder strap. It should be understood that grip loop may be a closed loops with a mechanism for adjustment. In a preferred embodiment the grip loops may however be opened completely, and thereby in a easy way be entwined to the elongated object.

In the preferred embodiment each grip loop 1, 2 is attached to itself by being placed one above the other and/or attached to the shoulder strap 5. Further the longitudinal piece 4, which is an extension of the shoulder strap 5, is disposed around the lower end of the elongated object. The longitudinal piece will prevent the object from sliding down through the grip loop, and should therefore be provided with a grip capable to withstand the expected load of the object to be carried, such as the weight of any kind of skis.

The carrying device can easily be folded into a compact unit. By opening the fastening buckle 3, the carrying device is divided in two units and the carrying device is folded together by folding the grip loop 1, 2 and the shoulder strap 5, and the carrying device remains folded by one of the fastening means 3, 6, 6'.

The carrying device for the elongated object comprises adjustable components that may be aligned to various sizes of the elongated object to be carried, and to individual requirements of the users. The carrying device may be used to carry any elongated object. Elongated objects to which the carrying device is suitable, are for example, all types of skis, boards, etc. While carrying skis the cross-pieces of the grip loops 1, 2 will keep the skis together when the cross-pieces are disposed around the skis and fastened. The cross-pieces may be fastened with velcro, but all known suitable fastening mechanisms could be used. The design of the grip loops enables a flexible adjustment to e.g. different kind of skis with different width and size.

Padding material disposed in the grip loops on the faces facing toward the object will extend the durability of the carrying device due to less wear from e.g. sharp steel edges. The padding material will also protect the skis. This is especially useful for protecting the rear end of the skis, which are often a weak point and could easily be damaged, e.g. by hitting the ground.

The carrying device could consist of any suitable material, e.g., cordura, or other materials with similar properties that meet the requirement of strength and flexibility. The fastening buckle 3 is in the preferred embodiment made of plastic, but can alternatively be made of metal, composite, or any other suitable materials.

The carrying device is easy to pack into a small compact unit when not in use. The folded carrying device is the size of a wallet and have no loose straps or similar when folded. It is therefore very easy to bring with when it is not in use. In addition to the carrying device having a small volume and is easy to bring along, it is also easily wrapped around the object, e.g. skis, and provide a convenient manner of carrying the object.

While the invention has been described using specific examples and a limited number of embodiments, those skilled in the art, having benefit of this disclosure, will appreciate that other embodiments can be devised which do not depart from the scope of the invention as defined in the accompanying claims.

The invention claimed is:

1. A foldable ski carrying device wherein the carrying device is foldable and comprises an adjustable upper and lower grip loop where the upper and lower grip loops are connected with an adjustable shoulder strap, where each grip loop has at least one cross-piece extending laterally from one of the ends of the shoulder strap, and where the cross-piece(s) of the upper grip loop is disposable around an upper section of the skis and attachable to each other and/or to the shoulder strap by first fastening means, and cross-piece(s) of the lower grip loop is disposable around a lower part of the skis and attached to each other and/or to the shoulder strap by second fastening means, wherein said first and second fastening means includes velcro, and further comprising a flat longitudinal piece overlapping and extending longitudinally along a lower end of the shoulder strap and having a width wider than a width of the shoulder strap, the lower grip loop located at the bottom most end of the adjustable shoulder strap and longitudinal piece, the longitudinal piece adapted to be foldable at a folding axis to be disposed around a lower end of the skis facing the ground, wherein the folding axis is above the lower grip loop, where the lower grip loop, connected with the shoulder strap, is coated with a padding material on a side facing the skis, where the adjustable shoulder strap comprises a third fastening means, and where the ski carrying device is foldable into a compact device where the grip loops and the shoulder strap are folded and fixed in a folded state by one of the fastening means.

2. The carrying device of claim 1, where the third fastening means is a fastening buckle, and the length of the shoulder strap can be adjusted by the fastening buckle.

3. Method for using the foldable ski carrying device according to claim 1, comprising the steps of:

disposing the upper grip loop around the upper section of the skis, disposing the lower grip loop around the lower section of the skis, and adjusting the grip loop and/or shoulder strap, where the lower grip loop is coated with a padding material on a side facing the skis, and disposing the flat longitudinal piece extending longitudinally from the lower end of the shoulder strap, around to a lower end of the skis facing the ground.

4. The method of claim 3, wherein disposing the upper and/or lower grip loops involves attaching the cross-pieces, of the grip loops to each other by placing one above the other and/or to the shoulder strap.

5. The method of claim 3, further comprising; folding the carrying device into a compact device, and lock the carrying device in its folded state by using one of the fastening means.

6. The method of claim 4, further comprising; folding the carrying device into a compact device, and lock the carrying device in its folded state by using one of the fastening means.

7. A foldable ski carrying device wherein the carrying device is foldable and comprises an adjustable upper and lower grip loop where the upper and lower grip loops are connected with an adjustable shoulder strap, where each grip loop has at least one cross-piece extending laterally from one of the ends of the shoulder strap, and where the cross-piece(s) of the upper grip loop is disposable around an upper section of the skis and attachable to each other and/or to the shoulder strap by first fastening means, and cross-piece(s) of the lower grip loop is disposable around a lower part of the skis and attached to each other and/or to the shoulder strap by second fastening means, wherein the first and second fastening means includes velcro, and further comprising a planar longitudinal piece overlapping and extending longitudinally from a lower end of the shoulder strap and having a width wider than a width of the shoulder strap, the lower grip loop located at the bottom most end of the adjustable shoulder strap and longitudinal piece, the longitudinal piece adapted to be foldable, at a folding axis, wherein the folding axis is above the lower grip loop, wherein the longitudinal piece is folded over an end of the lower part of the skis so as to be disposed around the end of the lower part of the skis and the lower grip loop is attached overlapping the longitudinal piece around the lower part of the skis, where at least one of the grip loops is coated with a padding material on a side facing the skis where the adjustable shoulder strap comprises a third fastening means, and where the carrying device is foldable into a compact device where the grip loops and the shoulder strap are folded and fixed in a folded state by one of the fastening means.

8. The carrying device according to claim 7, wherein the longitudinal piece is foldable into a U-shape to hold the lower part of the object.

9. The carrying device according to claim 7, wherein lower side surfaces of the skis near the end of the lower part of the skis are exposed and not covered by the longitudinal piece when the longitudinal piece is folded over the end of the lower part of the skis.

10. The carrying device according to claim 7, wherein the lower grip loop, connected to the shoulder strap, is coated with the padding material.

11. The carrying device according to claim 7, wherein the longitudinal piece, when folded, prevents the skis from sliding through the lower grip loop.

12. The carrying device according to claim 7, wherein each grip loop forms a T-shape with the shoulder strap.

* * * * *